US008051510B2

(12) United States Patent
Soloway

(10) Patent No.: US 8,051,510 B2
(45) Date of Patent: Nov. 8, 2011

(54) FOLDABLE DIAPER BAG, CHANGING SURFACE, AND PLAY PAD ASSEMBLY

(76) Inventor: Sharon R. Soloway, Tucson, AZ (US)

( * ) Notice: Subject to any disclaimer, the term of this patent is extended or adjusted under 35 U.S.C. 154(b) by 0 days.

(21) Appl. No.: 11/465,770

(22) Filed: Aug. 18, 2006

(65) Prior Publication Data

US 2007/0214574 A1 Sep. 20, 2007

Related U.S. Application Data

(63) Continuation-in-part of application No. 11/376,499, filed on Mar. 15, 2006.

(51) Int. Cl.
*A47G 9/06* (2006.01)
*B65D 30/00* (2006.01)

(52) U.S. Cl. ..... 5/417; 5/420; 5/485; 5/655; 383/4; 190/1

(58) Field of Classification Search ..... 5/655, 417, 5/4–17, 420, 947; 383/4, 16, 110, 111, 116; 393/38, 39; 206/494; 190/1
See application file for complete search history.

(56) References Cited

U.S. PATENT DOCUMENTS

| | | | | |
|---|---|---|---|---|
| 2,672,628 | A | | 3/1954 | Spanel |
| 3,073,367 | A | | 1/1963 | Samara |
| 3,143,748 | A | | 8/1964 | Manning |
| 3,489,194 | A | | 1/1970 | Hoover |
| D230,117 | S | | 1/1974 | Johnson |
| 3,976,113 | A | | 8/1976 | Kim |
| 4,188,988 | A | | 2/1980 | Agyagos |
| 4,337,812 | A | | 7/1982 | Trinkner |
| 4,466,516 | A | | 8/1984 | Sicoli et al. |
| 4,468,810 | A | | 8/1984 | Longo |
| 4,566,130 | A | | 1/1986 | Coates |
| 4,600,091 | A | | 7/1986 | McLeod |
| 4,671,393 | A | * | 6/1987 | Rainey ..... 190/1 |
| 4,685,570 | A | | 8/1987 | Medow |
| 4,723,300 | A | | 2/1988 | Aranow |
| 4,738,545 | A | | 4/1988 | Westgor |
| 4,789,247 | A | | 12/1988 | Schnoor |
| 4,794,029 | A | | 12/1988 | Tennant et al. |
| D299,979 | S | | 2/1989 | Garrison |
| 4,856,912 | A | | 8/1989 | Damus et al. |
| 4,881,684 | A | * | 11/1989 | Chinman ..... 190/115 |

(Continued)

FOREIGN PATENT DOCUMENTS

WO WO2006010001 1/2006

OTHER PUBLICATIONS

Deluxe Fold & Go Diapering Kit, http://www.thefirstyears.com/products/product.asp?pValue=4360, 2004, The First Years, printed from the internet Nov. 1, 2004.*

(Continued)

*Primary Examiner* — Thomas Beach
*Assistant Examiner* — Alyson M Merlino
(74) *Attorney, Agent, or Firm* — Hayes Soloway P.C.

(57) ABSTRACT

A foldable diaper bag, changing surface and play pad assembly is disclosed. The foldable diaper bag, changing surface, and play pad assembly comprises a circular portion and a rectangular portion attached to and extending outwardly from said circular portion, wherein said circular portion in combination with said rectangular portion define a keyhole shape.

17 Claims, 16 Drawing Sheets

U.S. PATENT DOCUMENTS

| | | | | | |
|---|---|---|---|---|---|
| 4,886,150 | A | | 12/1989 | Fitzsimmons | |
| 4,917,505 | A | | 4/1990 | Bullard et al. | |
| 4,984,906 | A | | 1/1991 | Little | |
| 4,991,978 | A | | 2/1991 | Ostrowski | |
| 4,999,863 | A | * | 3/1991 | Kane | 5/98.1 |
| 5,035,013 | A | | 7/1991 | Bloom | |
| 5,048,975 | A | | 9/1991 | Holbrook | |
| 5,088,139 | A | | 2/1992 | Bloom | |
| D324,970 | S | | 3/1992 | Kane | |
| 5,103,514 | A | * | 4/1992 | Leach | 5/417 |
| 5,103,515 | A | | 4/1992 | Bird | |
| 5,110,219 | A | | 5/1992 | Lopes | |
| D328,683 | S | * | 8/1992 | Kalozdi | D6/601 |
| D330,139 | S | * | 10/1992 | Bloom | D6/596 |
| 5,187,823 | A | | 2/1993 | Ferguson et al. | |
| 5,195,828 | A | | 3/1993 | Bush-Rodriquez | |
| 5,207,508 | A | | 5/1993 | Koutsis, Jr. | |
| 5,265,289 | A | | 11/1993 | Swiger et al. | |
| 5,370,460 | A | | 12/1994 | Nelson | |
| 5,414,881 | A | * | 5/1995 | Terrazas | 5/417 |
| 5,429,541 | A | | 7/1995 | Landon | |
| 5,480,229 | A | | 1/1996 | Thangsrirojkul | |
| 5,482,374 | A | | 1/1996 | Buhyoff | |
| 5,533,653 | A | | 7/1996 | Kaufman | |
| 5,611,095 | A | | 3/1997 | Schneider | |
| 5,611,098 | A | * | 3/1997 | Skibik | 5/653 |
| 5,692,257 | A | | 12/1997 | Albertieri | |
| 5,735,004 | A | * | 4/1998 | Wooten et al. | 5/502 |
| 5,737,785 | A | * | 4/1998 | Casey | 5/419 |
| 5,743,649 | A | | 4/1998 | Gonzalez | |
| 5,819,343 | A | | 10/1998 | Zampirri, Jr. et al. | |
| D407,216 | S | | 3/1999 | Vickers | |
| 5,887,301 | A | | 3/1999 | Anderson | |
| 5,895,118 | A | | 4/1999 | Hensley | |
| 5,938,336 | A | | 8/1999 | King | |
| 5,971,611 | A | | 10/1999 | Rosengren | |
| D421,178 | S | | 2/2000 | Dandini | |
| 6,053,634 | A | | 4/2000 | Kay | |
| 6,058,530 | A | | 5/2000 | Wheeler | |
| 6,176,356 | B1 | * | 1/2001 | Powley | 190/1 |
| 6,212,711 | B1 | * | 4/2001 | Gilmour | 5/420 |
| 6,224,152 | B1 | | 5/2001 | Hughes et al. | |
| 6,276,828 | B1 | | 8/2001 | Otley et al. | |
| 6,283,260 | B1 | | 9/2001 | Yasuda, Sr. | |
| 6,327,726 | B1 | | 12/2001 | Weber | |
| 6,427,267 | B1 | | 8/2002 | Turner | |
| 6,634,042 | B2 | * | 10/2003 | Blossman | 5/499 |
| D482,224 | S | | 11/2003 | DeCet | |
| 6,662,390 | B1 | * | 12/2003 | Berger | 5/486 |
| 6,694,552 | B1 | | 2/2004 | Vickers | |
| 6,785,921 | B1 | | 9/2004 | Conforti | |
| D508,181 | S | | 8/2005 | Welch | |
| 2004/0155077 | A1 | | 8/2004 | Cullen et al. | |
| 2005/0036715 | A1 | | 2/2005 | Delaney | |
| 2005/0039260 | A1 | | 2/2005 | Tyler | |
| 2005/0210594 | A1 | * | 9/2005 | Pistiolis et al. | 5/655 |

OTHER PUBLICATIONS

The First Years—Deluxe Fold & Go Diapering Kit, http://www.albeebaby.com/fiyedefogodi.html, Albee Baby.*

* cited by examiner

FOLDABLE DIAPER BAG, CHANGING SURFACE, AND PLAY PAD ASSEMBLY

CROSS REFERENCE TO RELATED APPLICATIONS

This application is a Continuation-In-Part claiming priority from a U.S. Utility application Ser. No. 11/376,499 filed Mar. 15, 2006.

FIELD OF THE INVENTION

The present invention is directed to an assembly which can be folded into as closed configuration comprising a handle for easy carrying, and when unfolded can be used as a diaper bag, a changing pad, and if needed, a soft, warm surface on which an infant can sleep, play, or eat.

BACKGROUND OF THE INVENTION

A variety of different types of blankets, changing pads, and diaper bags are currently available. Conventionally, diapers, wipes, and related products are carried in a diaper bag, and a separate blanket or changing pad is utilized as a surface when changing an infant's diaper. What is needed is an assembly which is easy to carry, and which can be used as a diaper bag, a changing pad, and if needed, a soft, warm surface on which an infant can sleep, play, or eat.

SUMMARY OF THE INVENTION

A foldable diaper bag, changing surface, and play pad assembly, comprising a circular portion and a rectangular portion attached to and extending outwardly from said circular portion, wherein said circular portion in combination with said rectangular portion defines a keyhole shape.

BRIEF DESCRIPTION OF THE DRAWINGS

The invention will be better understood from a reading of the following detailed description taken in conjunction with the drawings in which like reference designators are used to designate like elements, and in which.

DETAILED DESCRIPTION OF THE PREFERRED EMBODIMENTS

Figure 1A:
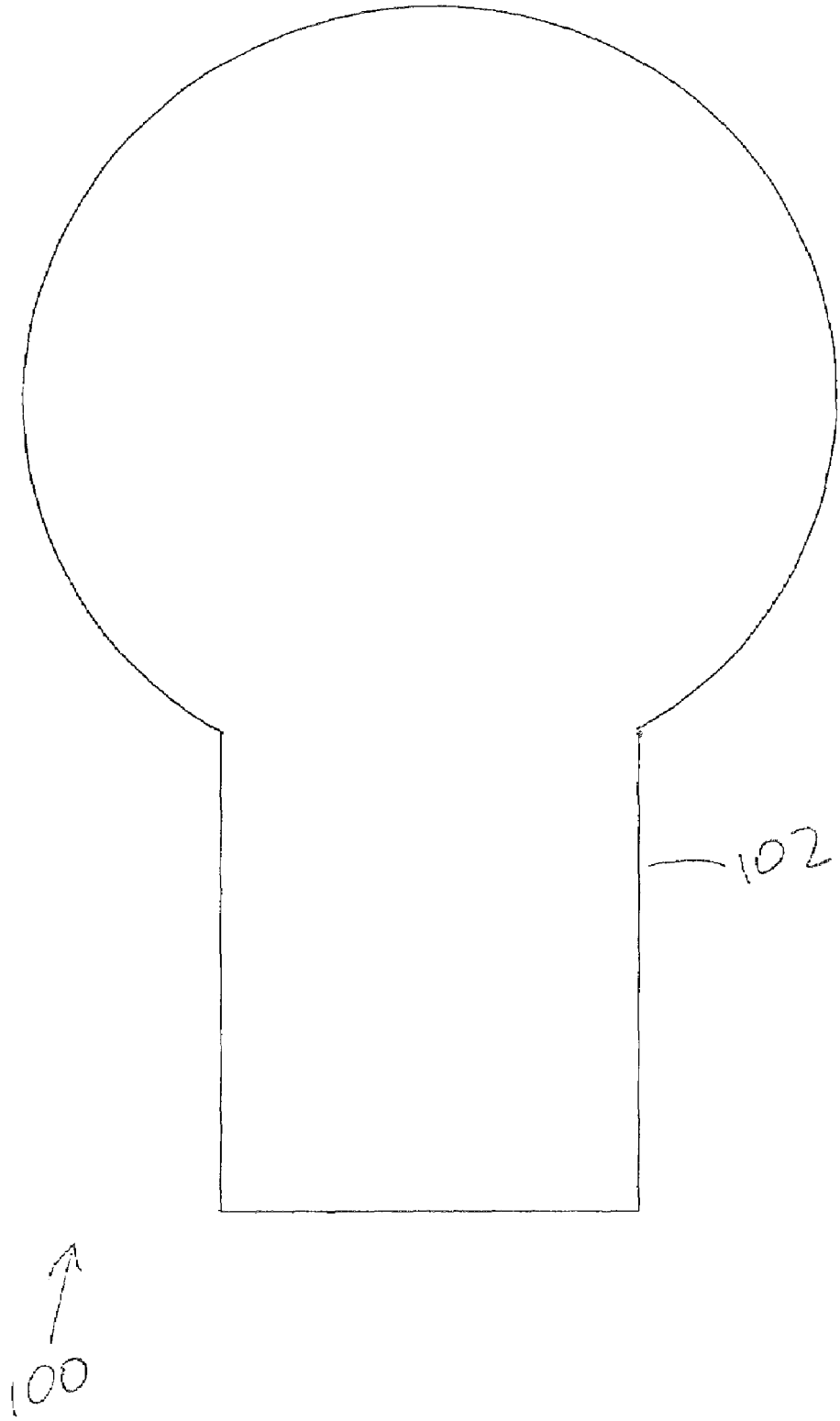
FIG. 1A is a cross-sectional view showing the shape of Applicant's foldable diaper bag, changing surface, and play pad assembly.

This invention is described in preferred embodiments in the following description with reference to the Figures, in which like numbers represent the same or similar elements. Referring now to FIG. 1A, Applicant's foldable diaper bag, changing surface, and play pad 100 comprises a "keyhole" shape 102.

Figure 1B:
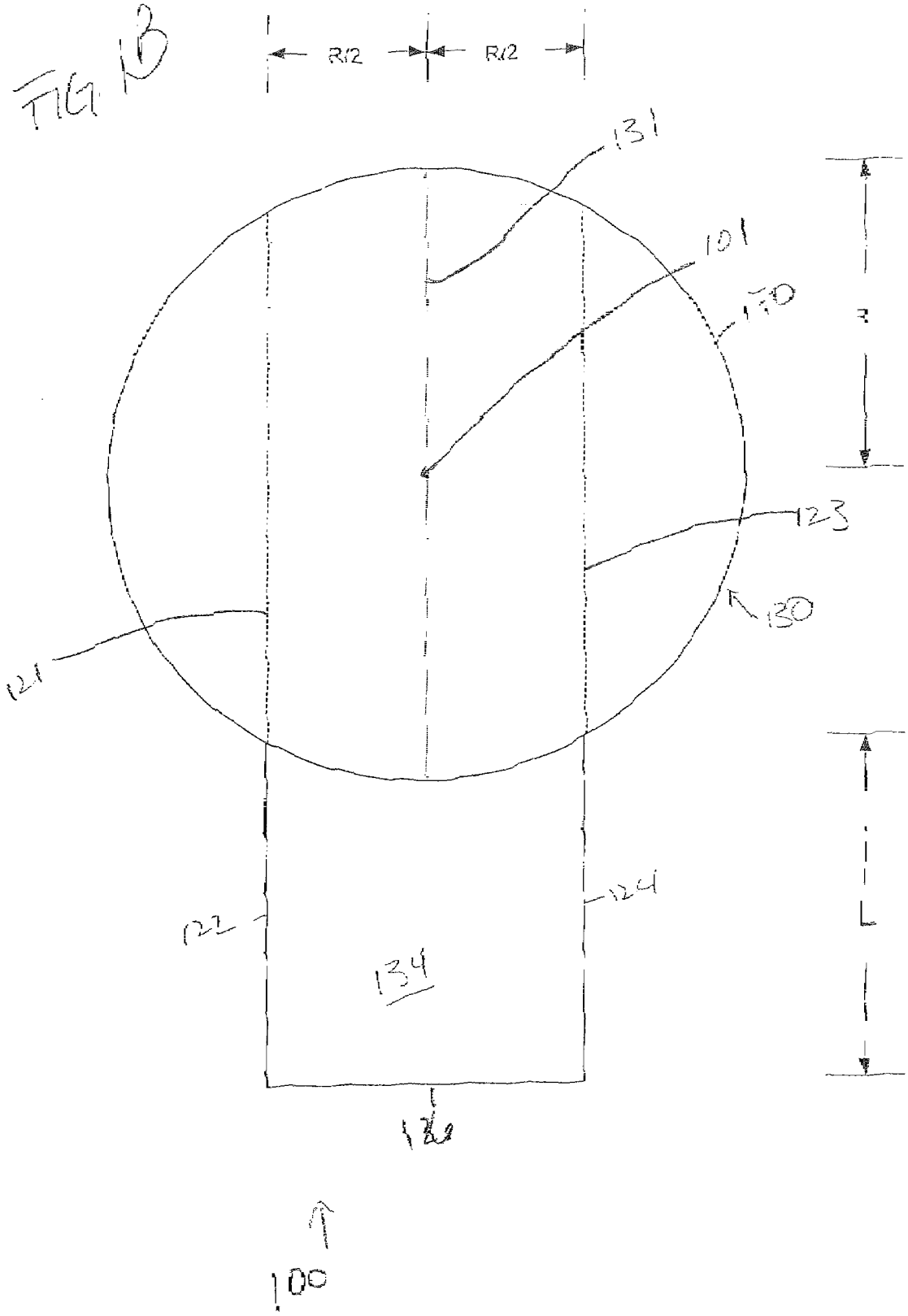
FIG. 1B is a cross-sectional view showing the elements of Applicant's foldable diaper bag, changing surface, and play pad assembly.

Referring to FIG. 1B, Applicant's foldable diaper bag, changing surface, and play pad 100 comprising keyhole shape 102 comprises circular portion 130 and rectangular portion 134. Circular portion 130 comprises radius R and peripheral edge 170. Rectangular portion 134 comprises sides 122, 124, and distal end 126.

Circular portion 130 further comprises vertical fold line 121, vertical fold line 123, and vertical centerline 131 passing through center point 101. Vertical fold line 121 is disposed a distance R/2 from centerline 131 in a first direction. Vertical fold line 123 is disposed a distance R/2 from centerline 131 in a second and opposite direction.

In the illustrated embodiment of FIG. 1B, distal end 126 of rectangular portion 134 has a width R. Rectangular portion 134 is symmetrically disposed around vertical centerline 131 such that side 122 is aligned with vertical fold line 121, and such that side 124 is aligned with vertical fold line 123. Sides 122 and 124 comprise a length L, wherein in certain embodiments L is between about 21 inches and about 24 inches.

Figure 1C:
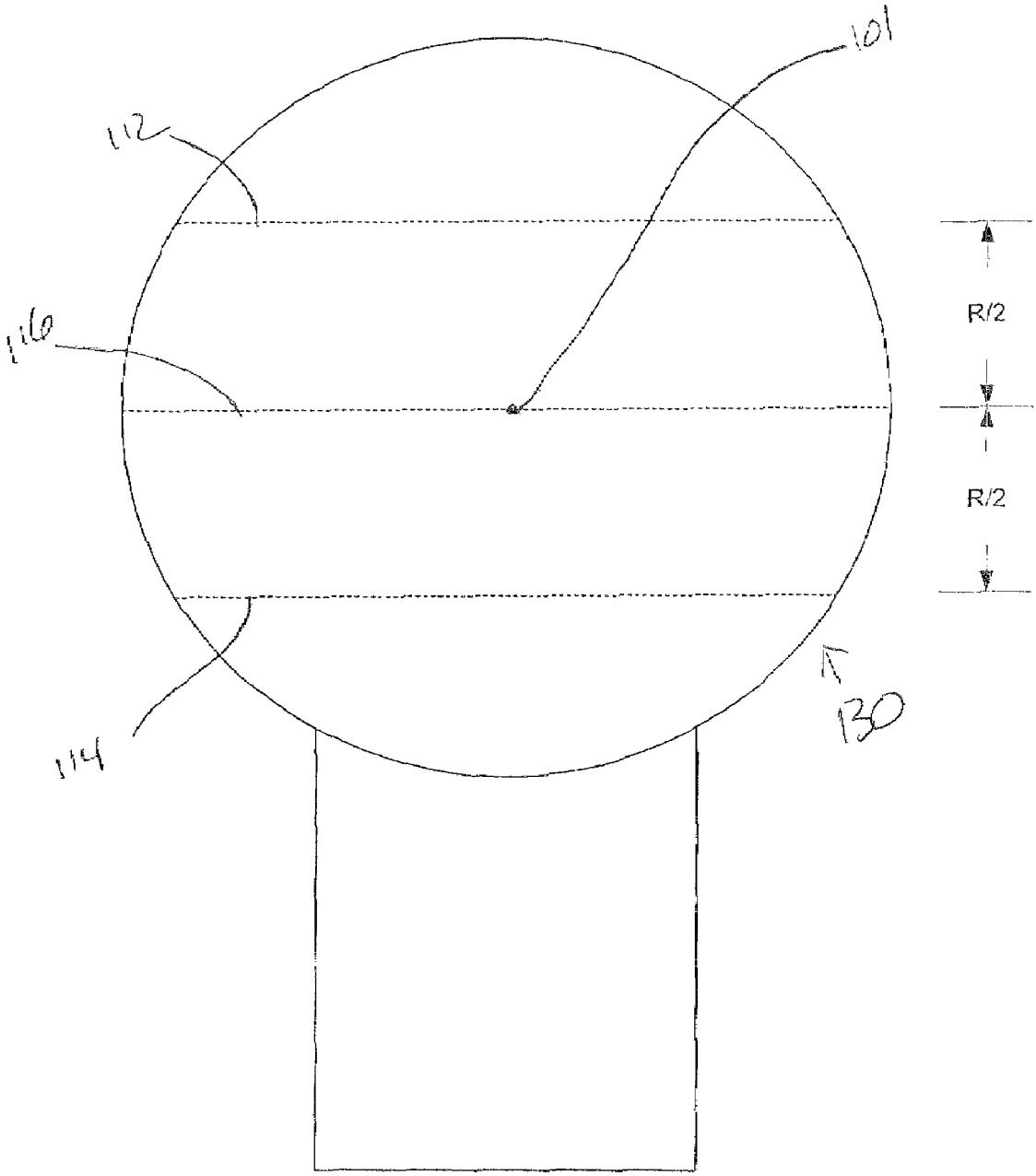
FIG. 1C is a cross-sectional view showing certain additional elements of Applicant's foldable diaper bag, changing surface, and play pad assembly.

Referring now to FIG. 1C, circular portion 130 further comprises horizontal centerline 116 passing through center point 101, horizontal fold line 112, and horizontal fold line 114. As those skilled in the art will appreciate, centerline 116 comprises the diameter of circular portion 130. In certain embodiments, circular portion 130 comprises a diameter of between about 4 feet and about 6 feet.

As those skilled in the art will further appreciate, the length of the diameter of circular portion 130 comprises twice the radius R of that circular portion. In the illustrated embodiment of FIG. 1C, horizontal fold line 112 is disposed a distance R/2 from horizontal centerline 116 in a first direction.

Horizontal fold line 114 is disposed a distance R/2 from horizontal centerline 116 in a second and opposing direction.

Figure 1D:
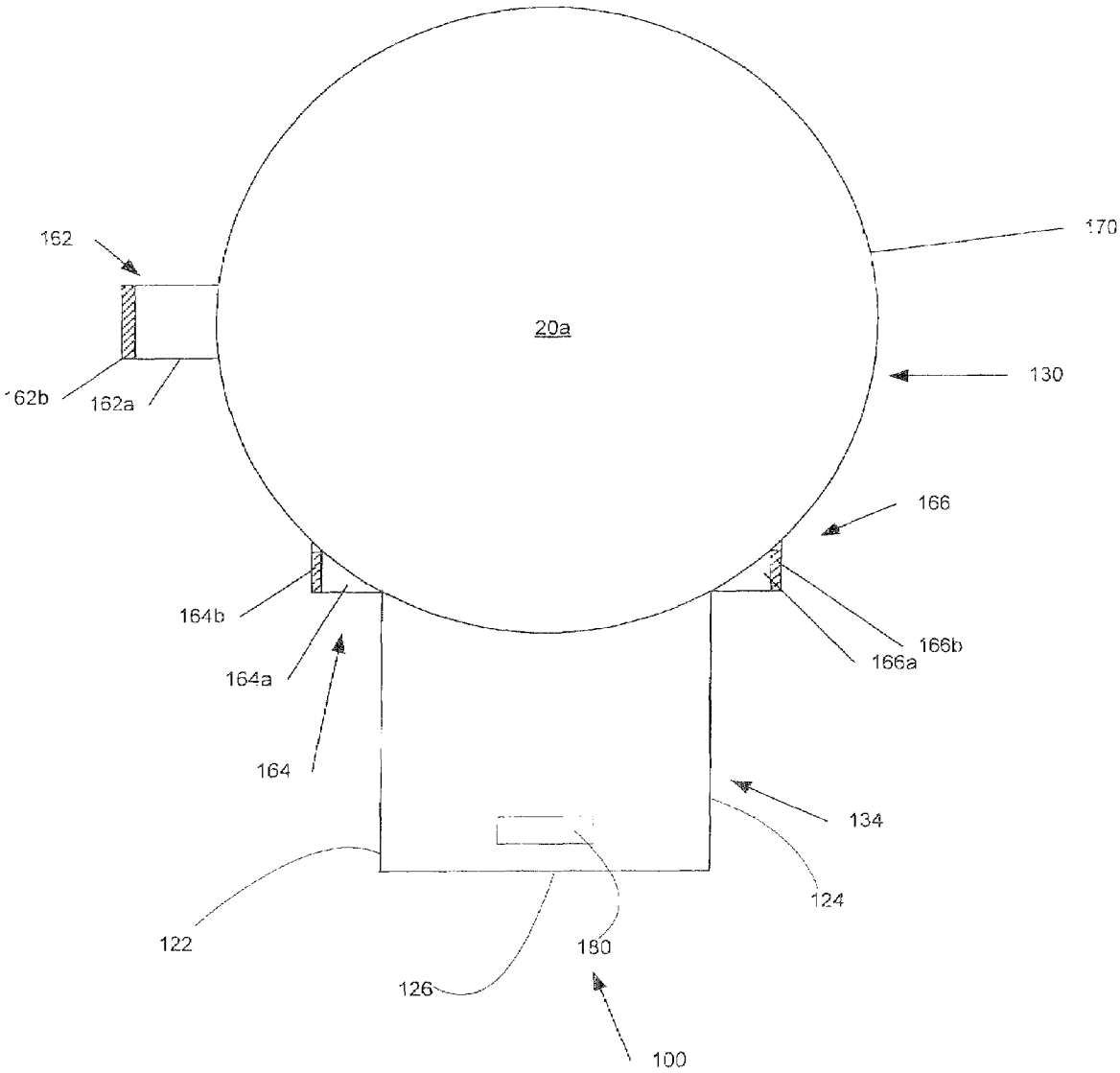
FIG. 1D is a block diagram showing the interior surface of Applicant's foldable diaper bag, changing surface, and play pad assembly.
Figure 1E:
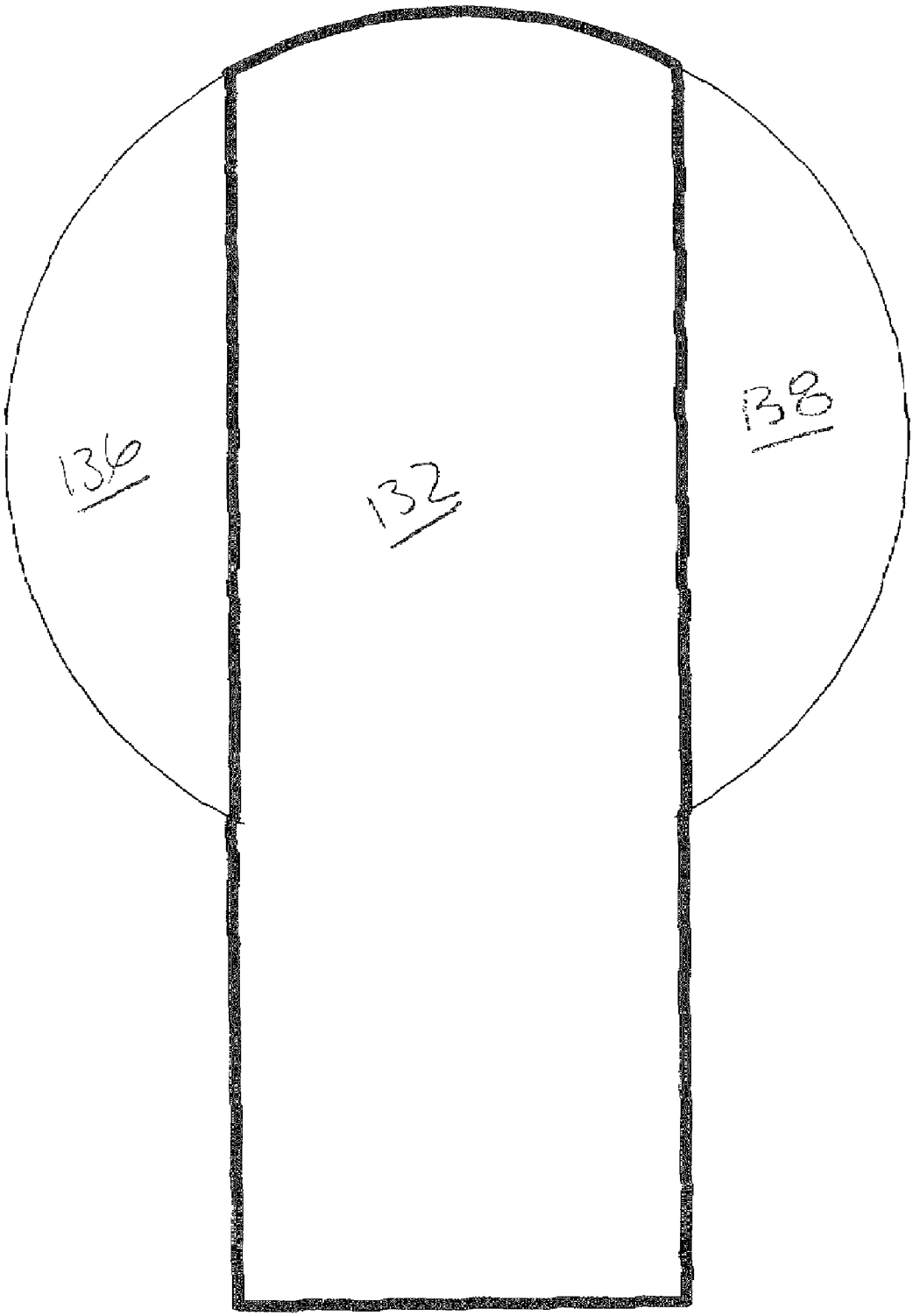
FIG. 1E is a block diagram showing a central portion and two outer portions comprising Applicant's foldable diaper bag, changing surface, and play pad assembly.

Referring now to FIG. 1E, Applicant's foldable diaper bag, changing surface, and play pad 100 comprises central portion 132, outer portion 136, and outer portion 138. Central portion 132 comprises rectangular portion 134 and the part of circular portion disposed between fold lines 121 and 123. In the illustrated embodiment of FIG. 1E, central portion 132 comprises about 72 percent of the surface area of Applicant's foldable diaper bag, changing surface, and play pad 100. Outer portion 136 comprises about 14 percent of the surface area of Applicant's foldable diaper bag, changing surface, and play pad 100. Outer portion 138 comprises about 14 percent of the surface area of Applicant's foldable diaper bag, changing surface, and play pad 100.

Figure 8A:
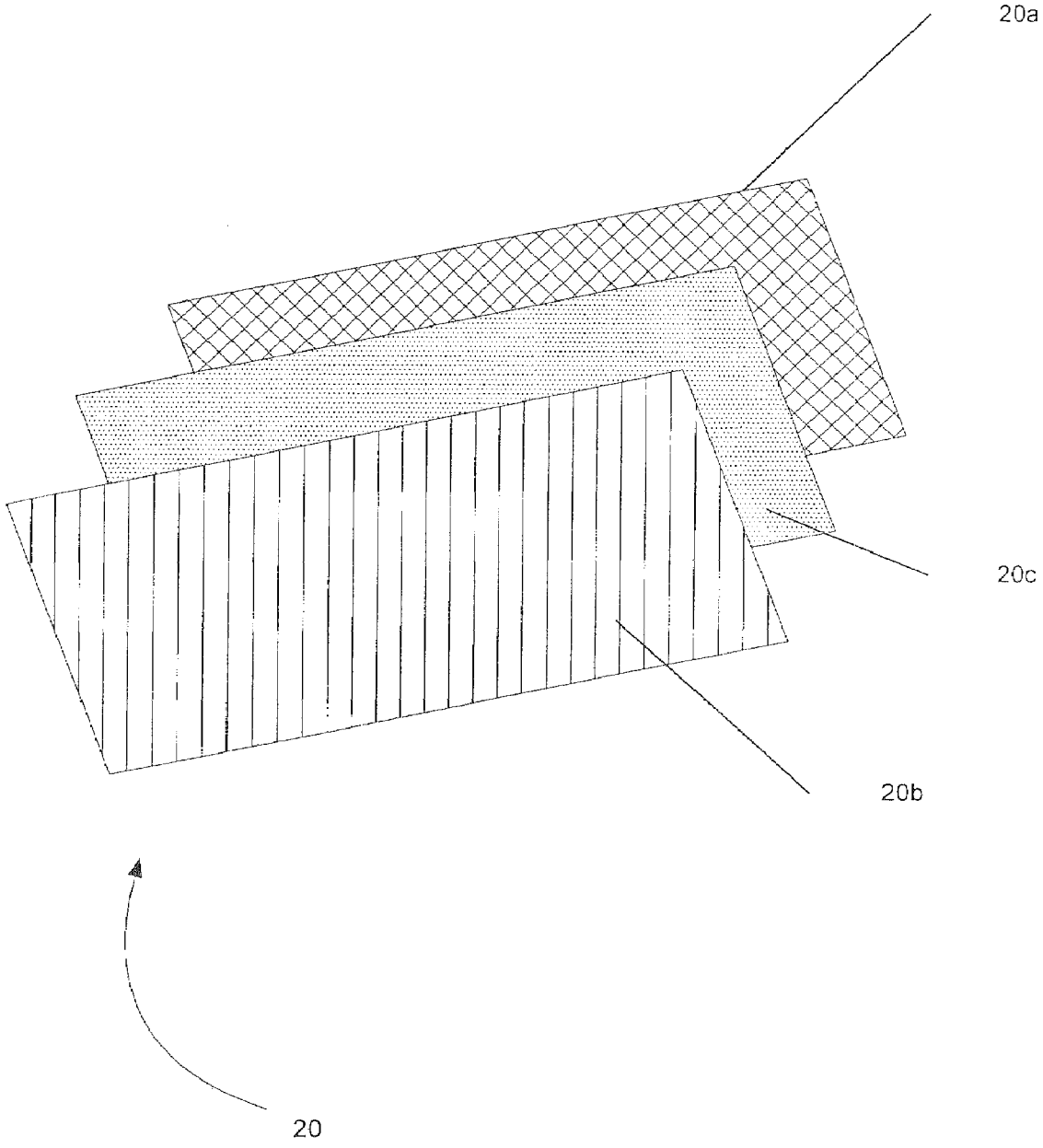
FIG. 8A is a perspective view showing the layers comprising a laminate material used to form Applicant's foldable diaper bag, changing surface, and play pad assembly.

Applicant's foldable diaper bag, changing surface, and play pad 100 is formed from a three layer laminate material. Referring now to FIG. 8A, Applicant's laminate material 20 comprises a first outer layer of material 20*a*, a second outer layer of material 20*b*, and inner layer of material 20*c*.

In certain embodiments, first outer layer of material 20*a* comprises a flexible material, such as and without limitation nylon, polyvinylchloride, canvas, cotton, combinations thereof, and the like. In certain embodiments, second outer layer of material 20*b* comprises a flexible material, such as and without limitation nylon, polyvinylchloride, canvas, cotton, combinations thereof, and the like. In certain embodiments, third inner layer of material 20*c* comprises cellular material, such as and without limitation a flexible polyurethane foam and the like.

In certain embodiments, inner layer 20*c* comprises a closed cell flexible foam. In certain embodiments, that closed cell flexible foam further comprises a thermally insulating material having a thermal conductivity $\lambda$ of less than 0.10 Watt per meter degree Kelvin (W/m K).

Figure 8B:
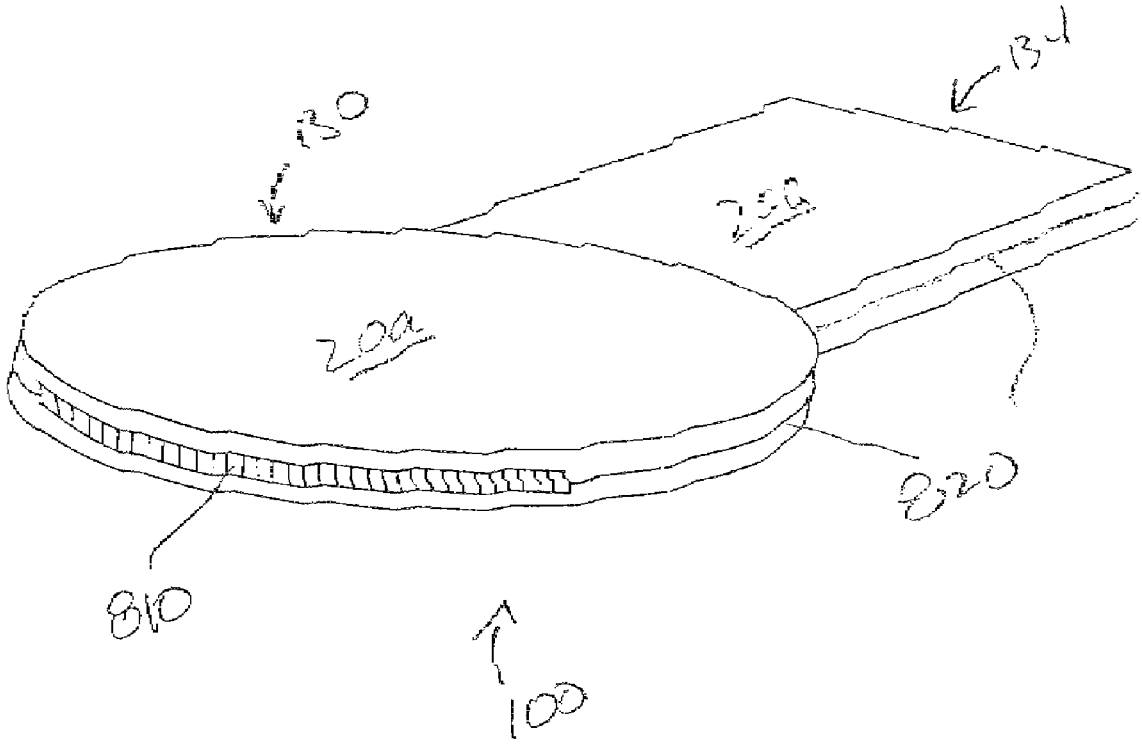
FIG. 8B is a perspective view of a first embodiment of Applicant's foldable diaper bag, changing surface, and play pad assembly.

Referring now to FIG. 8B, first outer layer 20*a* and second outer layer 20*b* are joined along seam 820 to enclose inner layer 20*c*. In certain embodiments, all or a portion of first outer layer 20*a* and second outer layer 20*b* are joined by closure means 810. In certain embodiments, closure means 810 comprises a zipper. In certain embodiments, closure means 810 comprises a plurality of snaps. In certain embodiments, closure means 810 comprises hook and loop fasteners. In embodiments of Applicant's invention wherein assembly 100 comprises closure means 810, the inner layer 20*c* may be removed and cleaned or replaced.

Figure 8C:
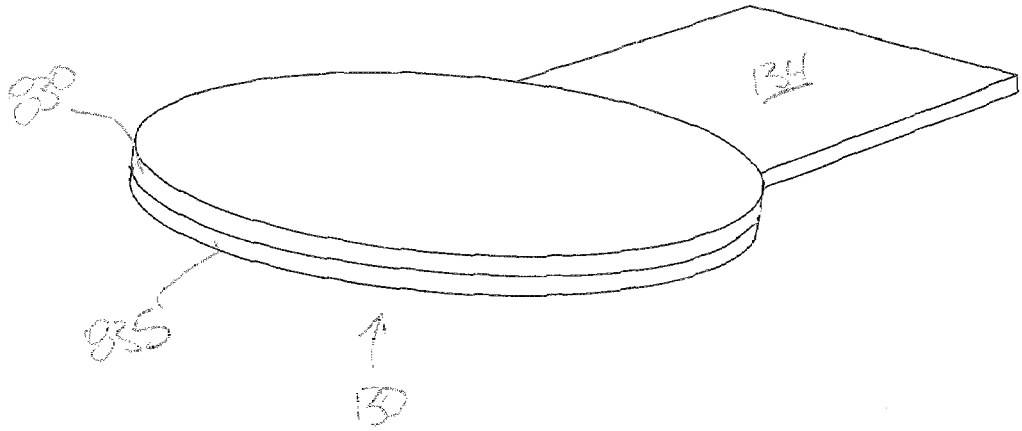
FIG. 8C is a perspective view of a second embodiment of Applicant's foldable diaper bag, changing surface, and play pad assembly.
Figure 8D:
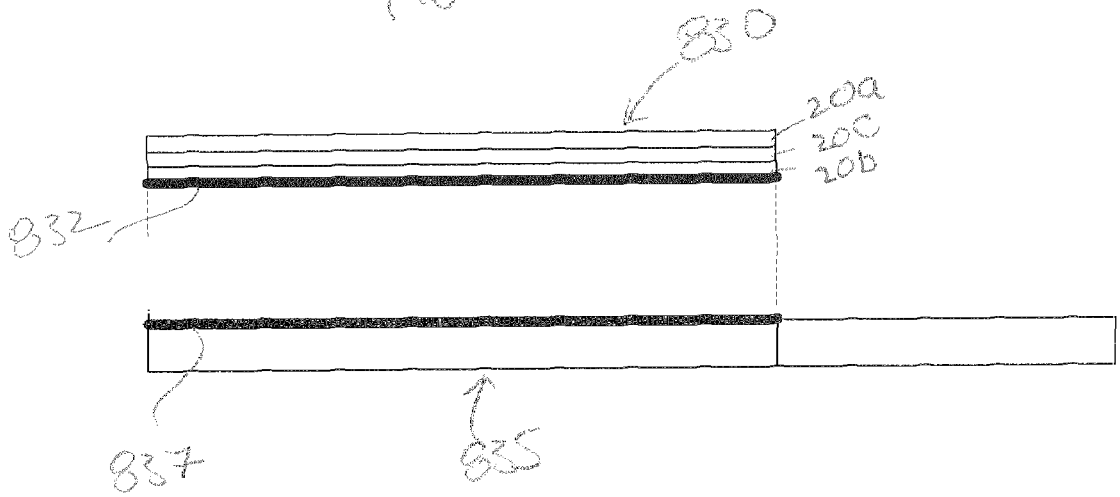
FIG. 8D is s side view of the embodiment of FIG. 8C.

Referring now to FIGS. 8C and 8D, circular portion 130 comprises a first circular assembly 830 which can be removed attached to second circular assembly 835, wherein rectangular portion 134 is attached to second circular assembly 835. Attachment means 832 is disposed along the periphery of first circular assembly 830, and second attachment means 837 is disposed along the periphery of second circular assembly 835. First attachment means 832 can be releaseably coupled to second attachment means 837.

In certain embodiments, first attachment means 832 comprises a plurality of hook-type fasteners, and second attachment means 837 comprises a plurality of loop-type fasteners, wherein the plurality of hooks 832 can be releaseably attached to the plurality of loops 837. In other embodiments, first attachment means 832 comprises a first zipper element and second attachment means 837 comprises a second zipper element, wherein the first zipper element 832 can be releaseably attached to the second zipper element 837. In still other embodiments, first attachment means 832 comprises a plurality of snaps, and second attachment means 837 comprises a plurality of snap-receivers, wherein the plurality of snaps 832 can be releaseably attached to the plurality of snap-receivers 837.

In certain embodiments, first circular assembly 830 comprises a three layer laminate. In the illustrated embodiment of FIG. 8D, first circular assembly 830 comprises a top layer 20*a*, a bottom layer 20*b*, and an interior layer 20*c*.

In certain embodiments, second circular portion 835 and rectangular portion 134 are separately formed and subsequently joined. In other embodiments, second circular portion 835 and rectangular portion 134 comprise are integrally formed.

FIG. 1D shows the outer surface of material 20*a* which comprises the interior of Applicant's folded assembly, and the top surface of Applicant's unfolded assembly. In the illustrated embodiment of FIG. 1D, circular portion 130 further comprises periphery 170, tab 162, tab 164, tab 166, and attachment means 180.

First tab 162 comprises a rectangular portion 162*a* and attachment means 162*b*. First tab 162 is attached to outer portion 136 (FIG. 1E) along periphery 170 and extends outwardly therefrom. Tab 162 is disposed symmetrically around horizontal centerline 116 (FIG. 1C). The distal end of tab 162 comprises attachment means 162*b*. Attachment means 162*b* can be releaseably attached to closure means 222 (FIG. 2A) when pad 100 is folded into the carrying configuration. Attachment means 162*b* in combination with closure means 222 comprise a conventional mechanical attachment device. By "mechanical attachment device," Applicant means hook and loop fasteners, snaps, zippers, or combinations thereof, and the like. In certain embodiments, first tab 162 comprises a flexible material, such as and without limitation nylon, polyvinylchloride, canvas, cotton, combinations thereof, and the like.

Figure 2A:
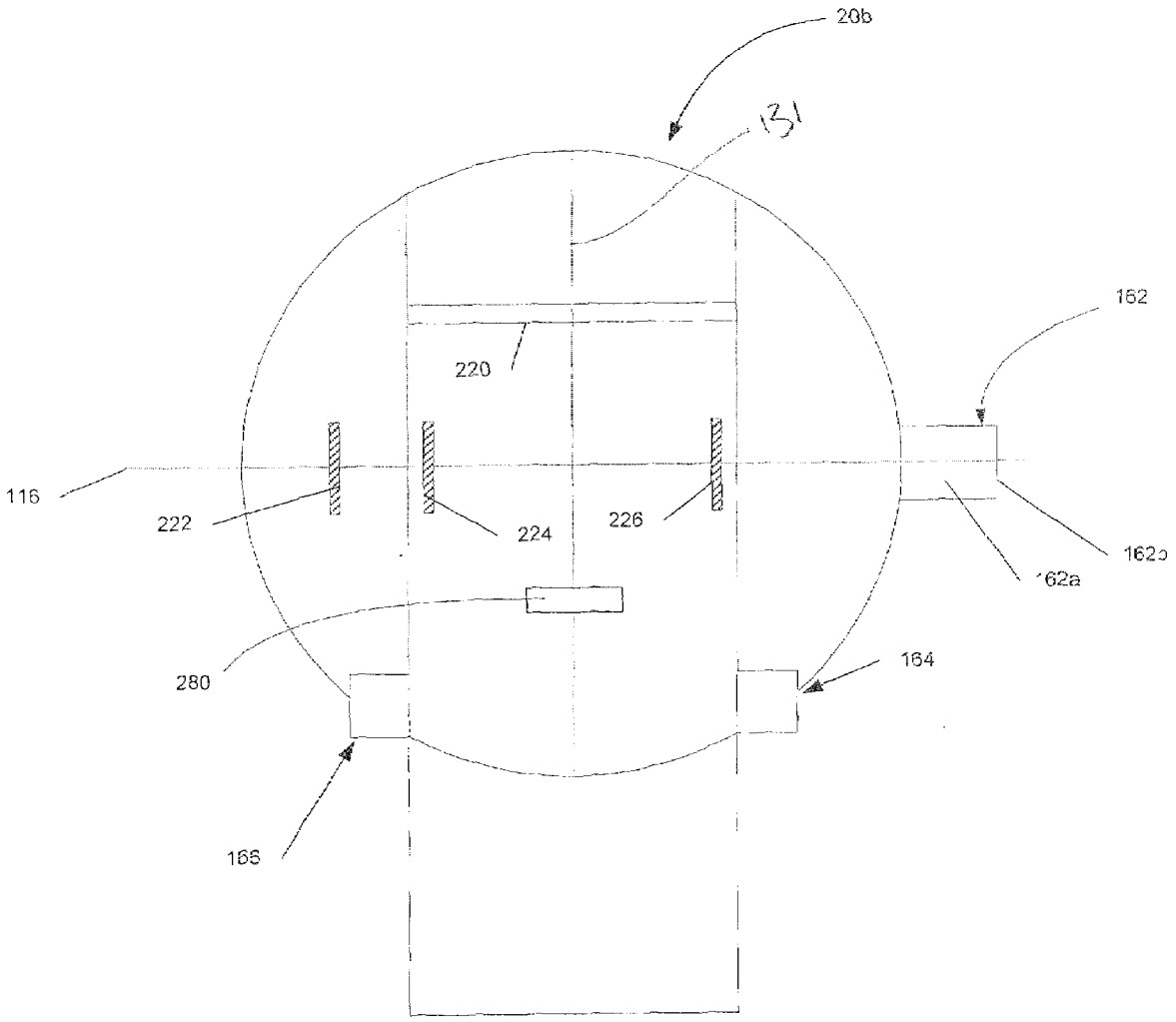
FIG. 2A is a block diagram showing a first embodiment of the exterior surface of Applicant's foldable diaper bag, changing surface, and play pad assembly.
Figure 2B:
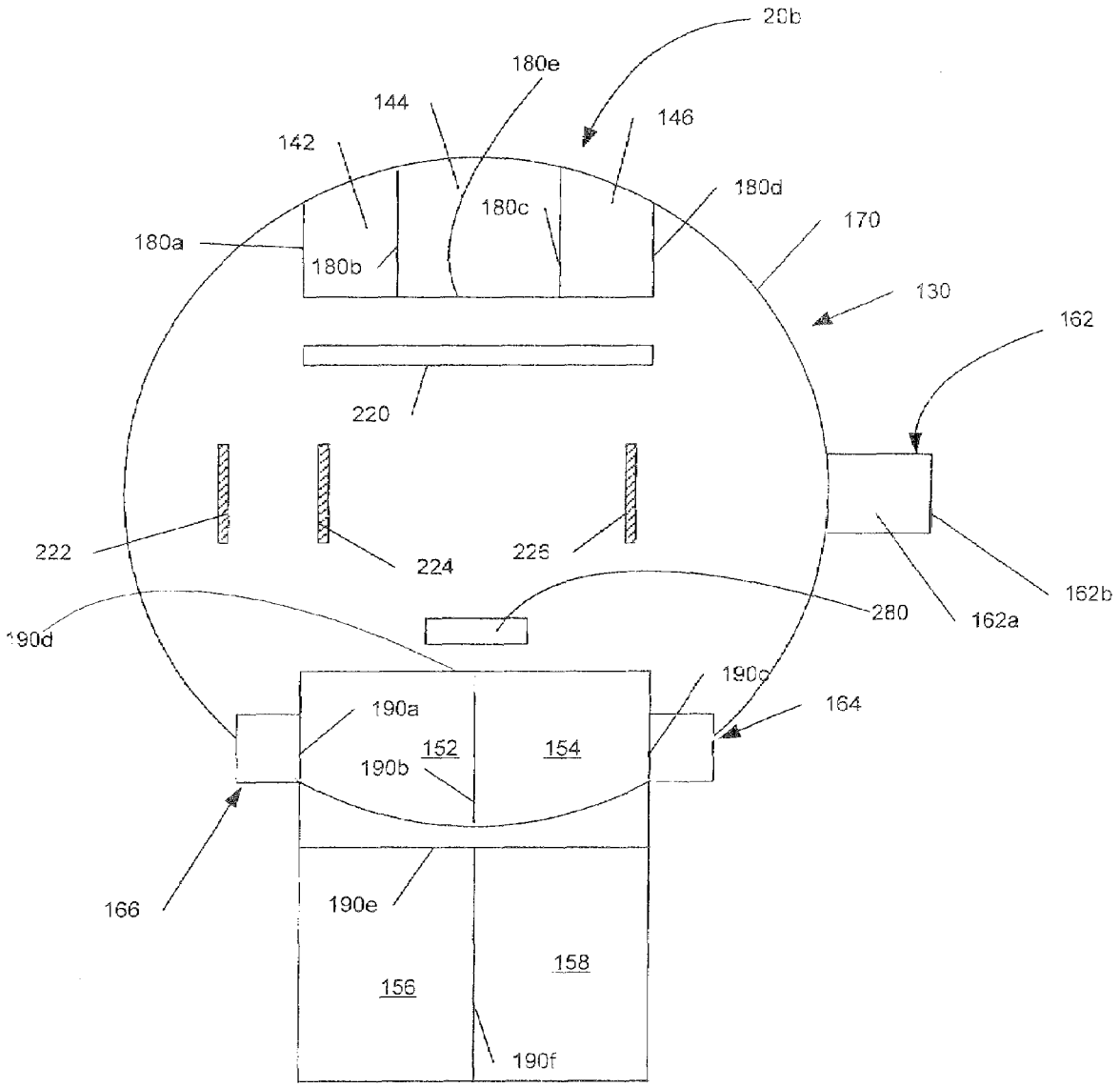
FIG. 2B is a block diagram showing a second embodiment of the exterior surface of Applicant's foldable diaper bag, changing surface, and play pad assembly.

Referring now to FIGS. 1D and 2A, second tab 164 comprises a rectangular portion 164*a* and attachment means 64*b* disposed on the distal end of rectangular portion 164*a*. Second tab 164 is attached to the exterior surface of material 20*b* (FIGS. 2, 8) along vertical fold line 121 (FIG. 11B) adjacent the attachment of side 122 (FIG. 1B) to periphery 170, and extends outwardly therefrom. Attachment means 164*b* can be releaseably attached to closure means 226 (FIG. 2A) when pad 100 is folded into the carrying configuration. Attachment means 164 in combination with closure means 226 comprise a conventional mechanical attachment device, as defined herein. In certain embodiments, second tab 164*a* comprises a flexible material, such as and without limitation nylon, polyvinylchloride, canvas, cotton, combinations thereof, and the Like.

Third tab 166 comprises a rectangular portion 166*a* and attachment means 166*b* disposed on the distal end of portion 166*a*. Third tab 166 is attached to the exterior surface of material 20*b* (FIGS. 2, 8) along fold line 123 (FIG. 1B) adjacent the attachment of side 124 (FIG. 1B) to periphery 170, and extends outwardly therefrom. Attachment means 166*b* can be releaseably attached to closure means 224 (FIG. 2A) when pad 100 is folded into the carrying configuration. Attachment means 166*b* in combination with closure means 224 comprise a conventional mechanical attachment device, as defined herein. In certain embodiments, third tab 166 comprises a flexible material, such as and without limitation nylon, polyvinylchloride, canvas, cotton, combinations thereof, and the like.

Attachment means 180 is disposed on rectangular portion 134 adjacent end 126. Referring to FIGS. 1D and 2A, attachment means 180 in combination with closure means 280 comprise a conventional mechanical attachment device. By "mechanical attachment device," Applicant means hook and loop fasteners, snaps, zippers, or combinations thereof, and the like.

FIG. 2A shows a first embodiment of the outer surface of material 20*b* (FIG. 8), which comprises the exterior of Applicant's folded assembly 100, and the bottom of Applicant's unfolded assembly 100. In addition to attachment means 222, 224, and 226, described hereinabove, handle assembly 220 is attached to the outer surface of material 20*b*, and closure means 280 is attached to the cuter surface of material 20*b* symmetrically around centerline 131.

In certain embodiments, Applicant's assembly comprises one or more pockets disposed on the outer surface of the folded configuration. In the illustrated embodiment of FIG. 2B, circular portion 130 further comprises pocket 142, pocket 144, pocket 146, pocket 152, and pocket 154. Pocket 142 is defined by seams 180*a*, 180*b*, and 180*e*. Pocket 144 is defined by seams 180*b*, 180*c*, and 180*e*. Pocket 146 is defined by seams 180*c*, 180*d*, and 180*e*. Pocket 152 is defined by seams 190*a*, 190*b*, and 190*d*. Pocket 154 is defined by seams 190*b*, 190*c*, and 190*d*. In the illustrated embodiment of FIG. 2B, rectangular portion 134 comprises pocket 156 and pocket 158. Pockets 156 and 158 are defined by seams 190*e* and 190*f*.

In other embodiments, Applicant's assembly comprises pockets 156 and 158 but not pockets 142, 144, 146, 152, or 154. In these embodiments, circular portion 130 does not comprise any pockets such that circular portion comprises a flat surface, while rectangular portion 134 comprises an irregular surface resulting from the objects disposed in pocket 156 and/or pocket 158.

Figure 3:
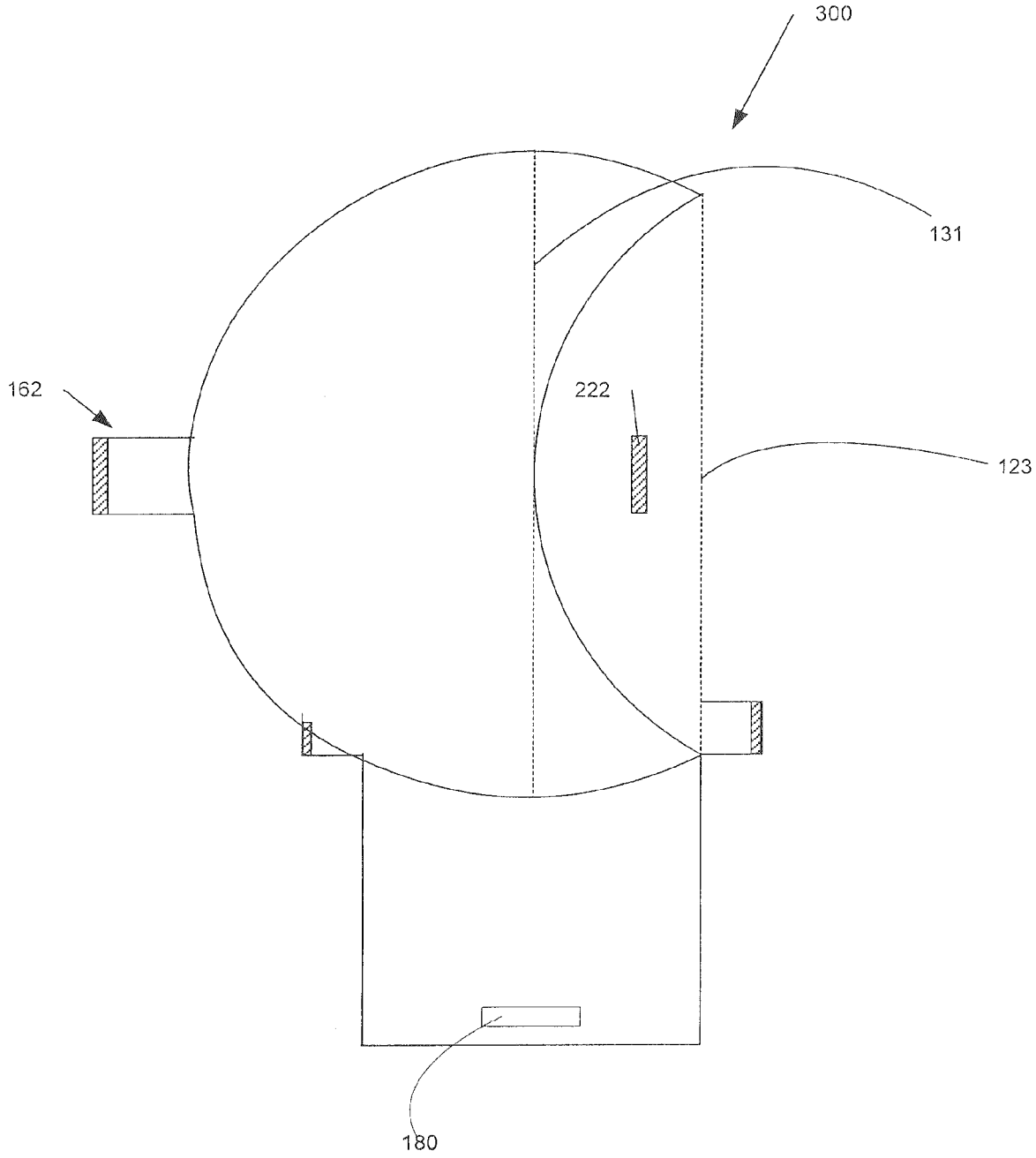
FIG. 3 is a top view of a first folded configuration of Applicant's foldable diaper bag, changing surface, and play pad assembly.

Referring to FIG. 3, Applicant's foldable diaper bag, changing surface, and play pad 100 is shown in the first folded configuration 300. To place assembly 100 into configuration 300, outer portion 138 is folded inwardly along vertical fold line 123 such a portion of periphery 170 touches vertical centerline 131.

Figure 4:
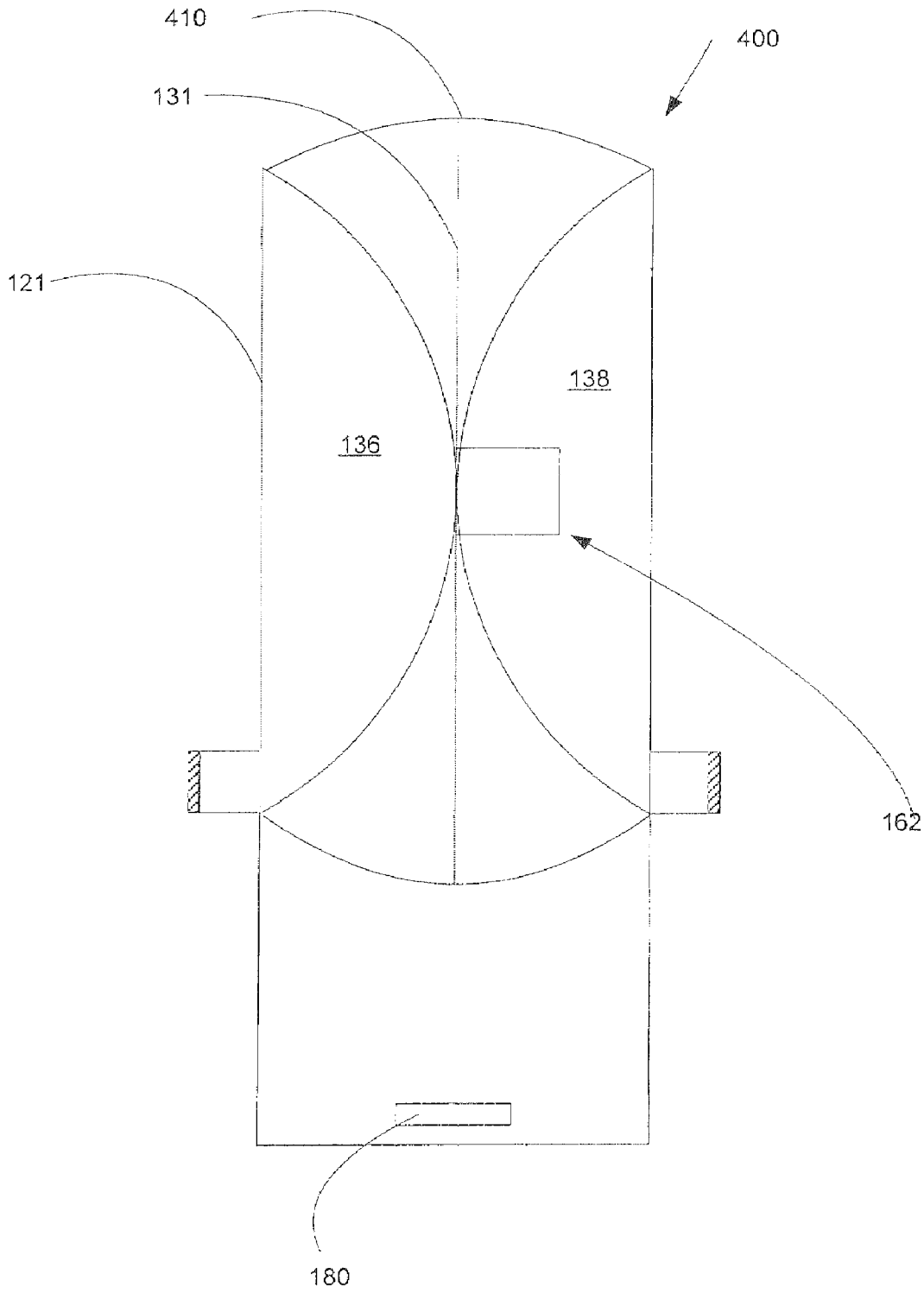
FIG. 4 is a top view of a second folded configuration of Applicant's foldable diaper bag, changing surface, and play pad assembly.

Referring to FIG. 4, Applicant's foldable diaper bag, changing surface, and play pad 100 is shown in the second folded configuration 400. To convert configuration 300 (FIG. 3) into configuration 400, outer portion 136 is folded inwardly along vertical fold line 121 such that a portion of side 136 is disposed adjacent vertical centerline 131. Configuration 400 corresponds to the footprint of central portion 132 (FIG. 1E). Point 410 comprises the intersection of vertical centerline 131 and periphery 170. When side 136 is folded inwardly, tab 162 overlays on side 138 and attachment means 162*b* contacts, and can be releaseably attached to, closure means 222.

Figure 5:
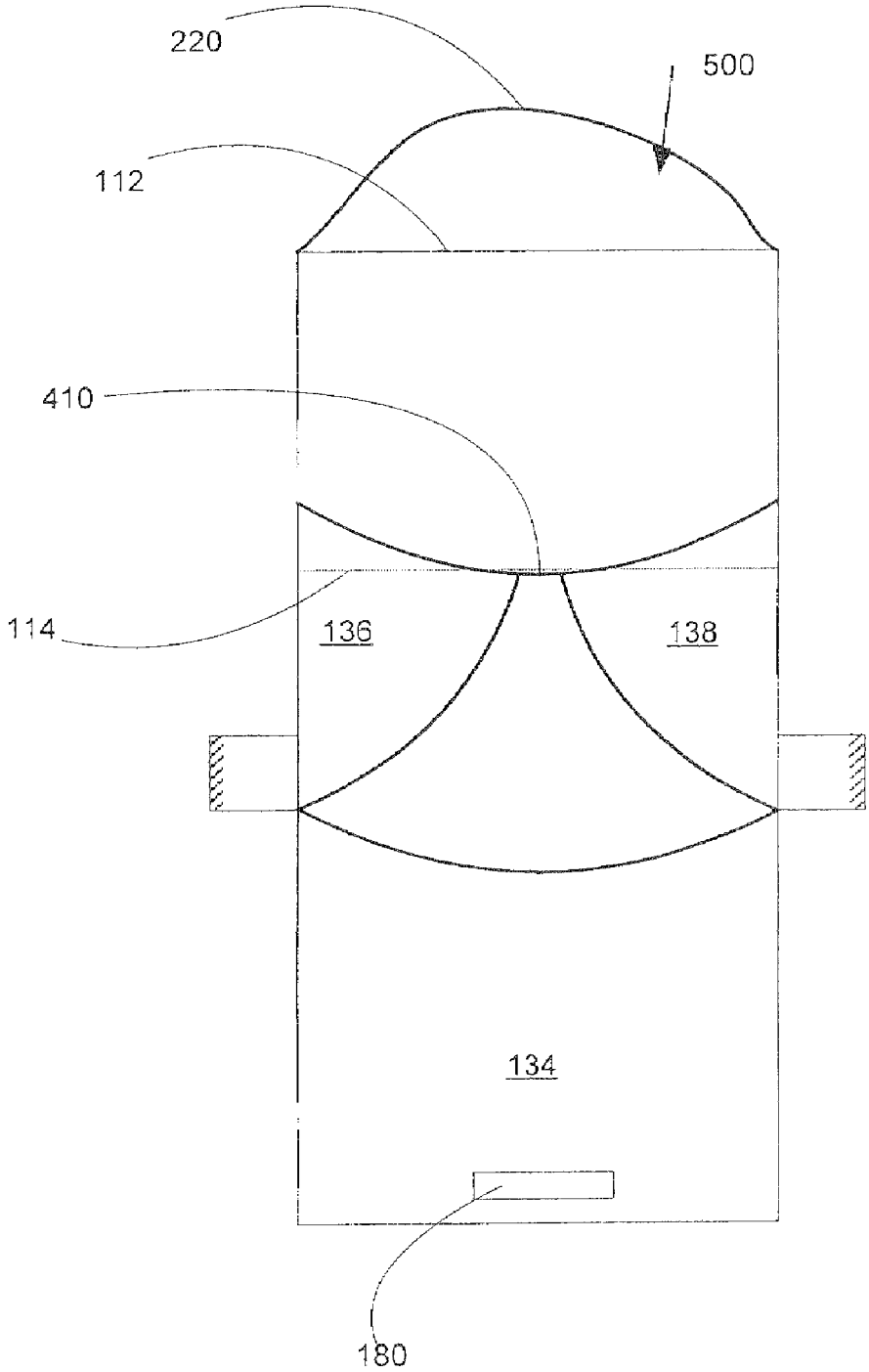
FIG. 5 is a top view of a third folded configuration of Applicant's foldable diaper bag, changing surface, and play pad assembly.

Referring to FIG. 5, Applicant's foldable diaper bag, changing surface, and play pad 100 is shown in the third folded configuration 500. To convert configuration 400 (FIG. 4) into configuration 500, central portion 132 is folded inwardly along horizontal fold line 112 such that point 410 is disposed adjacent horizontal fold line 114.

Figure 6:
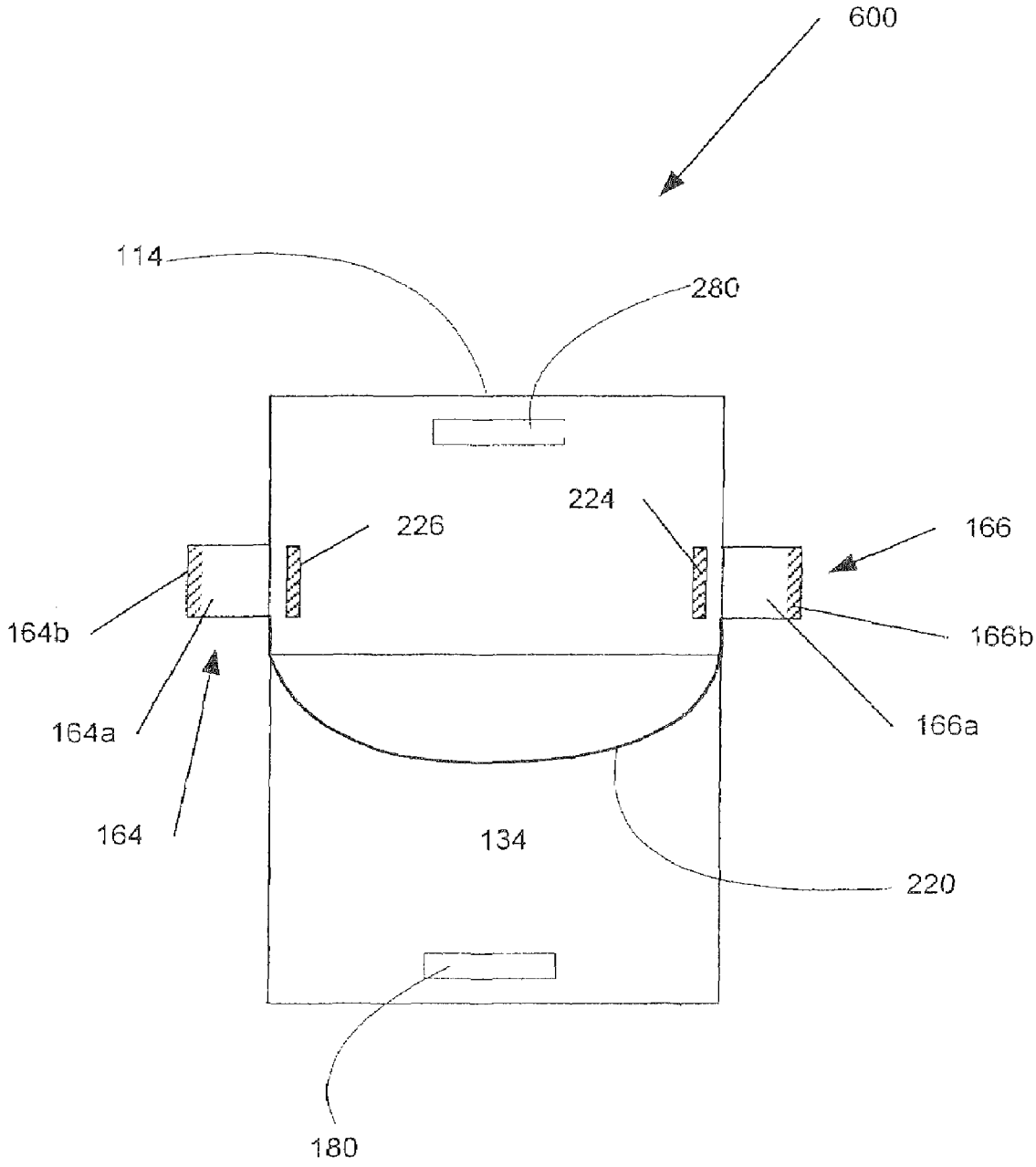
FIG. 6 is a top view of a fourth folded configuration of Applicant's foldable diaper bag, changing surface, and play pad assembly.

Referring to FIG. 6, Applicant's foldable diaper bag, changing surface, and play pad 100 is shown in the fourth folded position 600. To convert configuration 500 into configuration 600, configuration 500 is folded inwardly along horizontal fold line 114 such that attachment means 164*b* of tab 164 can be releaseably attached to closure means 226, and such that attachment means 166*b* of tab 166 can be releaseably attached to closure means 224.

Figure 7:
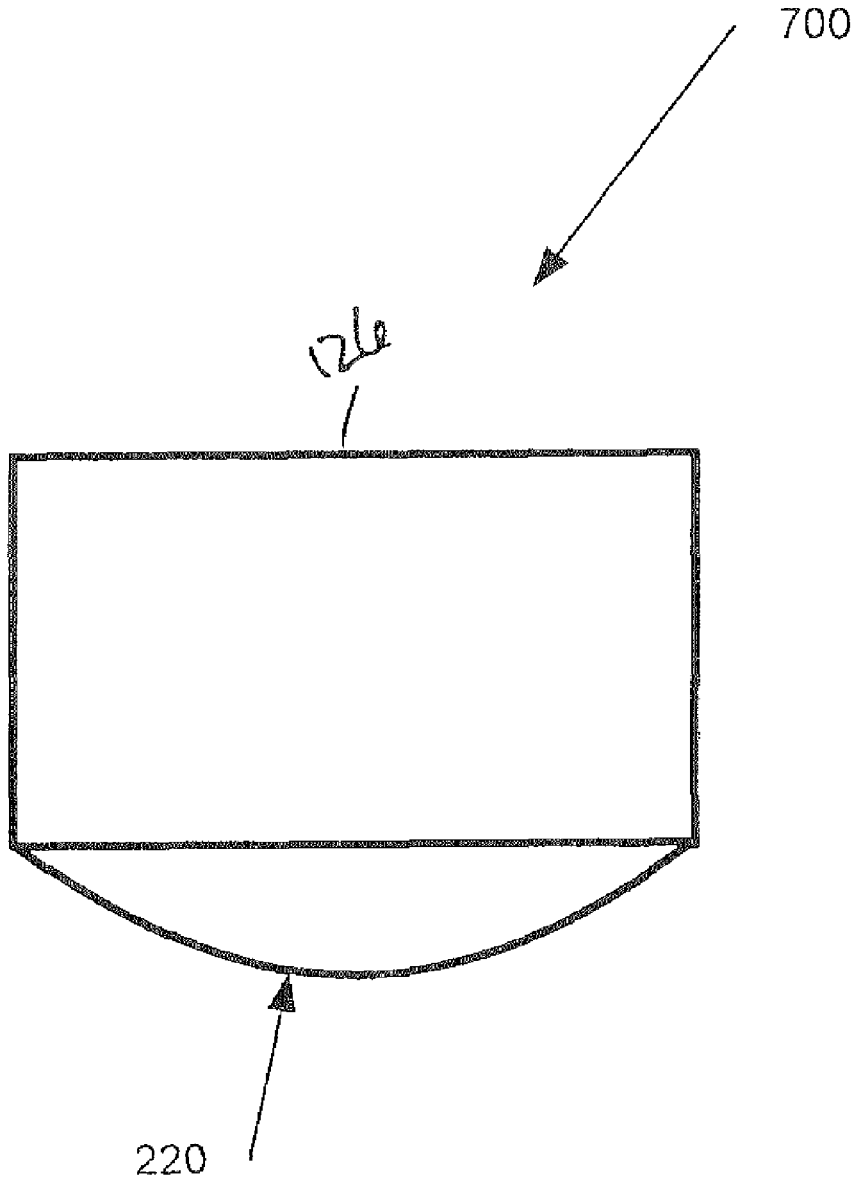
FIG. 7 is a top view of a fifth folded configuration of Applicant's foldable diaper bag, changing surface, and play pad assembly.

Referring to FIG. 7, Applicant's foldable diaper bag, changing surface, and play pad 100 is shown in the fifth folded position 700. To convert configuration 600 (FIG. 6) into configuration 700, rectangular portion 134 is folded upwardly and threaded underneath handle 220 so that distal end 126 is disposed adjacent the top edge of previously folded portions, and such that attachment means 180 contacts closure means 280. In the illustrated embodiment of FIG. 7, after rectangular portion 134 is folded upwardly, Applicant's foldable diaper bag, changing surface, and play pad 100 comprising folded configuration 700 can be carried using handle assembly 220.

In certain embodiments, handle 220 comprises a flexible material, such as and without limitation nylon, polyvinylchloride, canvas, cotton, combinations thereof, and the like. In certain embodiments, strap 220 is releaseably interconnected to rectangular portion 134 by a mechanical attachment means for easy carrying. By "mechanical attachment means," Applicant means hook and loop fasteners, snaps, zippers, or combinations thereof, and the like.

Figure 9:
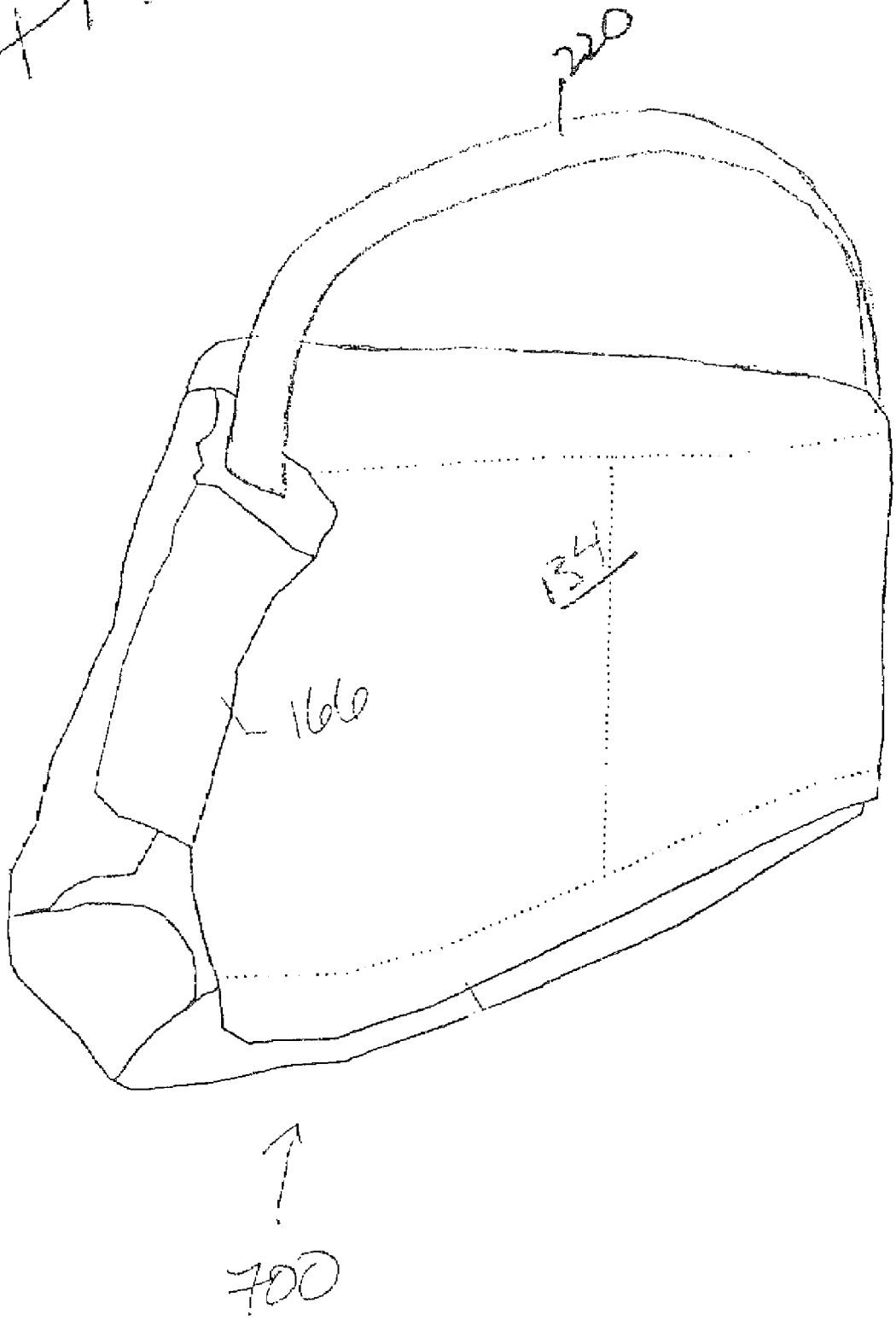
FIG. 9 is a perspective view of Applicant's foldable diaper bag, changing surface, and play pad assembly in a completely folded and portable configuration.

Referring to FIG. 9, Applicant's foldable diaper bag, changing surface, and play pad 100 is shown in the completely folded configuration 700.

While the preferred embodiments of the present invention have been illustrated in detail, it should be apparent that modifications and adaptations to those embodiments may occur to one skilled in the art without departing from the scope of the present invention as set forth in the following claims.

I claim:

1. A combination baby diaper bag, changing surface and play surface, comprising:

a circular portion having a periphery, a centerpoint, a top surface, and a bottom surface, a vertical centerline passing through said centerpoint, and a horizontal centerline passing through said centerpoint;

a rectangular portion extending outwardly from said circular portion;

a first vertical fold line and a second vertical fold line, wherein said vertical fold lines are disposed on opposite sides of said vertical centerline and running parallel thereto, and wherein said vertical fold lines divide said circular and rectangular portions into a first outer portion, a central portion, and a second outer portion, and wherein said rectangular portion has a first side aligned with said first vertical fold line and a second side aligned with said second vertical fold line;

a first horizontal fold line and a second horizontal fold line, wherein said horizontal fold lines are disposed on opposite sides of said horizontal centerline and running parallel thereto;

a first attachment device disposed at an intersection of said circular portion and said rectangular portion along said first vertical fold line, said first attachment device being detachably coupled to a first closure device disposed proximate to said first vertical fold line along said horizontal centerline;

a second attachment device disposed at an intersection of said circular portion and said rectangular portion along said second vertical fold line, said second attachment device being detachably coupled to a second closure device disposed proximate to said second vertical fold line along said horizontal centerline; and a strap;

wherein the circular portion folds along the first and second vertical fold lines such that a periphery of each of the first and second outer portions touches the vertical centerline, and wherein the circular portion successively folds at the first and second horizontal fold lines to place the circular portion in a folded state, thereby defining a volume with a first and second open end, and wherein the coupling of the first attachment device to the first closure device at least partially encloses the first open end, and wherein the coupling of the second attachment device to the second closure device at least partially encloses the second open end.

2. The combination baby diaper bag, changing surface and play surface of claim 1, wherein:

said central portion combined with said rectangular portion comprises about 72 percent of the surface area of said assembly; said first outer portion comprises about 14 percent of the surface area of said assembly; and said second outer portion comprises about 14 percent of the surface area of said assembly.

3. The combination baby diaper bag, changing surface and play surface of claim 1, formed from a 3 layer laminate comprising a first outer layer, a second outer layer, and an inner layer comprising a flexible foam.

4. The combination baby diaper bag, changing surface and play surface of claim 3, wherein said flexible foam comprises a closed cell flexible foam.

5. The combination baby diaper bag, changing surface and play surface of claim 4, wherein said closed cell flexible foam comprises a thermal conductivity of less than 0.10 Watt per meter degree Kelvin.

6. The combination baby diaper bag, changing surface and play surface of claim 3, wherein the first outer layer and second outer layer are reversibly closable to allow periodic removal of the inner layer.

7. The combination baby diaper bag, changing surface and play surface of claim 1, wherein said rectangular portion includes at least one pocket.

8. The combination baby diaper bag, changing surface and play surface of claim 1, wherein said circular portion includes at least one pocket.

9. The combination baby diaper bag, changing surface and play surface of claim 1, further comprising:

a third attachment device attached to said first outer portion; and a third closure device symmetrically disposed along said horizontal centerline on the bottom surface of said second outer portion, said third attachment device being releaseably attachable to said third closure device.

10. The combination baby diaper bag, changing surface and play surface of claim 1, wherein said circular portion and said rectangular portion are of unitary construction.

11. The combination baby diaper bag, changing surface and play surface of claim 1, wherein said rectangular portion comprises a separate element which is affixed to said circular portion.

12. The combination baby diaper bag, changing surface and play surface of claim 1, wherein the circular portion includes a detachable surface.

13. The combination baby diaper bag, changing surface and play surface of claim 12, wherein said detachable surface comprises a soft, warm surface.

14. The combination baby diaper bag, changing surface and play surface of claim 1, wherein the first attachment device is fixedly coupled to the bottom surface of the circular portion.

15. The combination baby diaper bag, changing surface and play surface of claim 1, wherein the strap is removeable.

16. The combination baby diaper bag, changing surface and play surface of claim 1, wherein said first attachment device comprises a mechanical attachment device.

17. The combination baby diaper bag, changing surface and play surface of claim 16, wherein said mechanical attachment device is selected from the group consisting of hook and loop fasteners, snaps and zippers.

* * * * *